US012473789B2

(12) United States Patent
Cornelio et al.

(10) Patent No.: US 12,473,789 B2
(45) Date of Patent: Nov. 18, 2025

(54) METHOD AND SYSTEM FOR CUTTING HYDRAULIC AND/OR ELECTRIC LINES IN THE ANNULAR SPACE OF A WELL

(71) Applicant: Schlumberger Technology Corporation, Sugar Land, TX (US)

(72) Inventors: Janio Cleydisson Cornelio, Macae (BR); Carlos Eduardo Guedes, Sugar Land, TX (US); Elias Nevoeiro Haik, Houston, TX (US)

(73) Assignee: SCHLUMBERGER TECHNOLOGY CORPORATION SUGAR, Sugar Land, TX (US)

( * ) Notice: Subject to any disclaimer, the term of this patent is extended or adjusted under 35 U.S.C. 154(b) by 0 days.

(21) Appl. No.: 18/838,522

(22) PCT Filed: May 8, 2023

(86) PCT No.: PCT/US2023/021349

§ 371 (c)(1),
(2) Date: Aug. 14, 2024

(87) PCT Pub. No.: WO2023/219947

PCT Pub. Date: Nov. 16, 2023

(65) Prior Publication Data

US 2025/0154841 A1 May 15, 2025

Related U.S. Application Data

(60) Provisional application No. 63/364,362, filed on May 9, 2022.

(51) Int. Cl.
*E21B 29/02* (2006.01)

(52) U.S. Cl.
CPC ..... *E21B 29/02* (2013.01)

(58) Field of Classification Search
CPC ..... E21B 29/02; E21B 43/119; E21B 31/002
See application file for complete search history.

(56) References Cited

U.S. PATENT DOCUMENTS 4,676,309 A * 6/1987 Gonzalez ..... E21B 43/117 175/46
6,009,811 A 1/2000 Newman et al.
(Continued)

FOREIGN PATENT DOCUMENTS

CN 111971453 A 11/2020

OTHER PUBLICATIONS

Search Report and Written Opinion of International Patent Application No. PCT/U52023/021349 dated on Aug. 25, 2023, 11 Pages.

*Primary Examiner* — Cathleen R Hutchins
(74) *Attorney, Agent, or Firm* — Jeffrey D. Frantz

(57) ABSTRACT

Described herein are methods and apparatus for idling a hydrocarbon well. A downhole tool is described that includes a tubular support and an explosive charge disposed within the tubular support, the explosive charge comprising a casing having the form of a cylinder with a wedge portion removed to form a wedge opening and a shaped charge shaped to fit the wedge opening. Methods described herein include positioning a partial radial cutter near an interior wall of a well completion tubing of a hydrocarbon well at a location opposite from an accessory conduit disposed in the well outside the well completion tubing, with the discharge portion of the partial radial cutter facing the interior wall of the well completion tubing, and discharging the partial radial cutter to penetrate a portion of the interior wall and sever the accessory conduit.

18 Claims, 4 Drawing Sheets

(56) References Cited

U.S. PATENT DOCUMENTS

| | | | | |
|---|---|---|---|---|
| 10,458,213 | B1 * | 10/2019 | Eitschberger | E21B 33/068 |
| 10,954,760 | B2 | 3/2021 | McNelis et al. | |
| 2014/0096950 | A1 * | 4/2014 | Pyecroft | E21B 43/2605 166/308.1 |
| 2015/0247370 | A1 | 9/2015 | Andrzejak | |
| 2020/0141213 | A1 * | 5/2020 | Collier | E21B 33/138 |

* cited by examiner

METHOD AND SYSTEM FOR CUTTING HYDRAULIC AND/OR ELECTRIC LINES IN THE ANNULAR SPACE OF A WELL

CROSS-REFERENCE TO RELATED APPLICATION

This application is a national stage entry under 35 U.S.C. § 371 of International Application No. PCT/US2023/021349, filed on May 8, 2023, which claims priority to and benefit of U.S. Provisional Patent Application No. 63/364,362, entitled "Method and System for Cutting Hydraulic and/or Electric Lines in the Annular Space of a Well", filed on May 9, 2022, which is incorporated herein by reference.

TECHNICAL FIELD

This patent application relates to methods and apparatus for idling hydrocarbon wells for abandonment. Specifically, cutting tools are described herein for cutting accessory conduits in hydrocarbon wells without severing completion tubing or harming well casings.

BACKGROUND

This section provides background information to facilitate a better understanding of the various aspects of the disclosure. It should be understood that the statements in this section of this document are to be read in this light, and not as admissions of prior art.

Hydrocarbons are commonly recovered from subterranean reservoirs by drilling a well into the reservoir, or a geologic formation associated with the reservoir. The well is a hole in the ground. To turn the well into a pathway for flowing hydrocarbons from the reservoir to the earth's surface, the well is typically cased and cemented. A tubular member is commonly inserted into the cased well to complete construction and prepare the well for production. The tubular member and the casing define an annular space around the tubular member.

Accessory conduits can be positioned in the annulus outside the tubular member between the tubular member and the well casing. These conduits are placed around the tubular member, and may be held in place against the tubular member using a clamp. The accessory conduits can be used to supply materials, power, and communication downhole.

In order to idle a well having such accessory conduits, the conduits must be severed, and then a cement plug must be installed within the tubular member and within the annular space between the tubular member and the well casing. In order to accomplish this configuration, a cutting tool is needed that can penetrate the tubular member and sever the conduits without completely severing the tubular member or damaging the casing.

SUMMARY

Certain embodiments commensurate in scope with the originally claimed disclosure are summarized below. These embodiments are not intended to limit the scope of the claimed disclosure, but rather these embodiments are intended only to provide a brief summary of possible forms of the disclosure. Indeed, embodiments may encompass a variety of forms that may be similar to or different from the embodiments set forth below.

Embodiments described herein provide a downhole tool, comprising a tubular support; and an explosive charge disposed within the tubular support, the explosive charge comprising a casing having a cylindrical form with a wedge portion removed to form a wedge opening; and a shaped charge shaped to fit the wedge opening.

Other embodiments described herein provide a method of idling a hydrocarbon well, comprising positioning a partial radial cutter near an interior wall of a well completion tubing of the well at a location opposite from an accessory conduit disposed in the well outside the well completion tubing, with the discharge portion of the partial radial cutter facing the interior wall of the well completion tubing; and discharging the partial radial cutter to penetrate a portion of the interior wall and cut the accessory conduit However, many modifications are possible without materially departing from the teachings of this disclosure. Accordingly, such modifications are intended to be included within the scope of this disclosure as defined in the claims.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments and are therefore not to be considered limiting of its scope, may admit to other equally effective embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

Figure 1A:
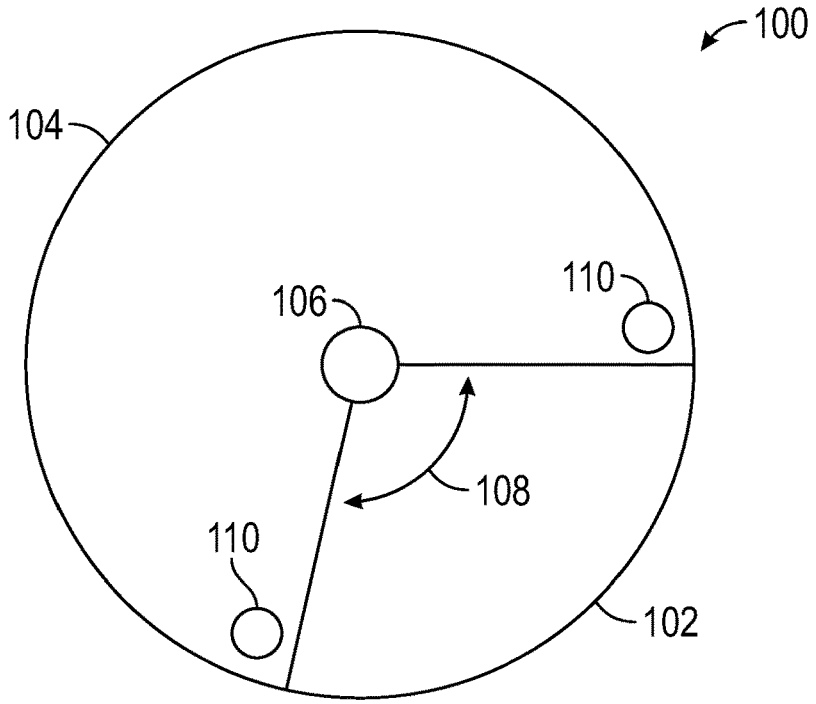
FIG. 1A is top view of a partial radial cutter according to one embodiment.

In the following description, numerous details are set forth to provide an understanding of the present disclosure. However, it may be understood by those skilled in the art that the methods of the present disclosure may be practiced without these details and that numerous variations or modifications from the described embodiments may be possible.

At the outset, it should be noted that in the development of any such actual embodiment, numerous implementation-specific decisions are made to achieve the developer's specific goals, such as compliance with system related and business related constraints, which will vary from one implementation to another. Moreover, it will be appreciated that such a development effort might be complex and time consuming but would nevertheless be a routine undertaking for those of ordinary skill in the art having the benefit of this disclosure. In addition, the composition used/disclosed herein can also comprise some components other than those cited. In the summary of the disclosure and this detailed description, each numerical value should be read once as modified by the term "about" (unless already expressly so modified), and then read again as not so modified unless otherwise indicated in context. The term about should be understood as any amount or range within 10% of the recited amount or range (for example, a range from about 1 to about 10 encompasses a range from 0.9 to 11). Also, in the summary and this detailed description, it should be understood that a concentration range listed or described as being useful, suitable, or the like, is intended that any concentration within the range, including the end points, is to be considered as having been stated. For example, "a range of from 1 to 10" is to be read as indicating each possible number along the continuum between about 1 and about 10. Furthermore, one or more of the data points in the present examples may be combined together, or may be combined with one of the data points in the specification to create a range, and thus include each possible value or number within this range. Thus, even if specific data points within the range, or even no data points within the range, are explicitly identified or refer to a few specific, it is to be understood that inventors appreciate and understand that any data points within the range are to be considered to have been specified, and that inventors possessed knowledge of the entire range and the points within the range.

Unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of concepts according to the disclosure. This description should be read to include one or at least one and the singular also includes the plural unless otherwise stated.

The terminology and phraseology used herein is for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited.

As used herein, "embodiments" refers to non-limiting examples disclosed herein, whether claimed or not, which may be employed or present alone or in any combination or permutation with one or more other embodiments. Each embodiment disclosed herein should be regarded both as an added feature to be used with one or more other embodiments, as well as an alternative to be used separately or in lieu of one or more other embodiments. It should be understood that no limitation of the scope of the claimed subject matter is thereby intended, any alterations and further modifications in the illustrated embodiments, and any further applications of the principles of the application as illustrated therein as would normally occur to one skilled in the art to which the disclosure relates are contemplated herein.

Moreover, the schematic illustrations and descriptions provided herein are understood to be examples only, and components and operations may be combined or divided, and added or removed, as well as re-ordered in whole or part, unless stated explicitly to the contrary herein. Certain operations illustrated may be implemented by a computer executing a computer program product on a computer readable medium, where the computer program comprises instructions causing the computer to execute one or more of the operations, or to issue commands to other devices to execute one or more of the operations.

In order to idle a hydrocarbon well having accessory conduits disposed in the annulus surrounding the well completion tubing, the accessory conduits must be severed so as not to provide a pathway for hydrocarbon to surface from the well bypassing the cement plug installed within the well completion tubing and the annulus. In so doing, the well completion tubing must remain intact, so that a cement plug can be installed, and the well casing should not be damaged.

FIG. 1A is a top view of a partial radial cutter 100 that can be used to idle a hydrocarbon well having accessory conduits. The cutter 100 is a partial radial cutter in that it contains an explosive charge 102 shaped to produce a discharge that propagates outward in a radial direction through a defined angle in the azimuthal direction. The explosive charge 102 is shaped like a wedge of a circle with an angular extent 108 selected to define the angular extent of the discharge. For the embodiments herein, the angular extent 108 is 90 to 120 degrees, for example about 100 degrees. The charge 102 is nested with a casing 104 that has the form of a cylinder with a wedge portion removed to form a wedge opening, so in FIG. 1A the casing has the appearance of a circle with a wedge of the circle removed. The removed portion matches the shape of the explosive charge 102, so the charge 102 nests within the wedge opening of the casing 104. The casing 104 can be metal, plastic, or both, and the explosive charge comprises a metal or plastic container with explosive material inside. The explosive charge 102 has a circular cutout at the narrow end thereof. The casing 104 also has a circular cutout located at the center of the circle defined by the edge of the casing 104. The two circular cutouts combine to form a conduit 106 along a central axis of the cutter 100. The conduit 106 provides ballistic transfer capability to activate the explosive charge 102. The casing 104 has alignment features 110 for positioning the cutter 100 to discharge in a desired direction.

Figure 1B:
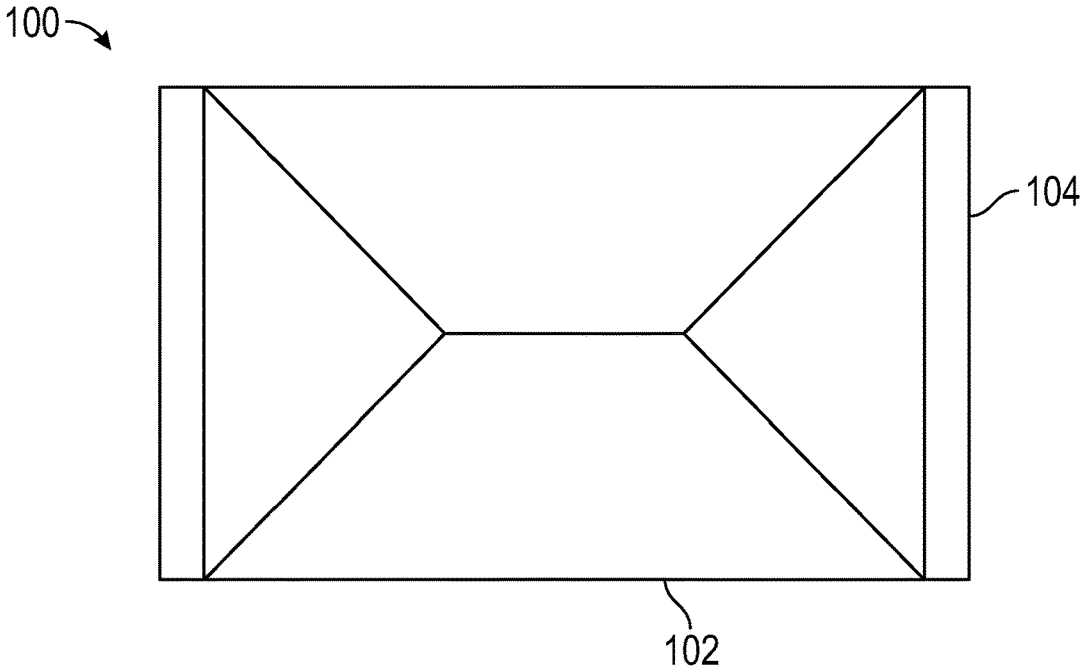
FIG. 1B is an elevation view of the partial radial cutter of FIG. 1A.

FIG. 1B is an elevation view of the cutter 100 of FIG. 1A. The view of FIG. 1B is looking along a bisection line of the explosive charge 102. From the side, the explosive charge 102 has an hourglass shape, as is common with radial cutters. In this case, of course, the explosive charge 102 is not a cylindrical body, but has the shape of a wedge from a cylindrical body. The explosive charge 102 is exposed at the opening of the casing, so the cutter 100 can be oriented to direct the discharge of the charge 102 in any desired direction by rotating the cutter 100 about the central axis thereof.

Figure 2A:
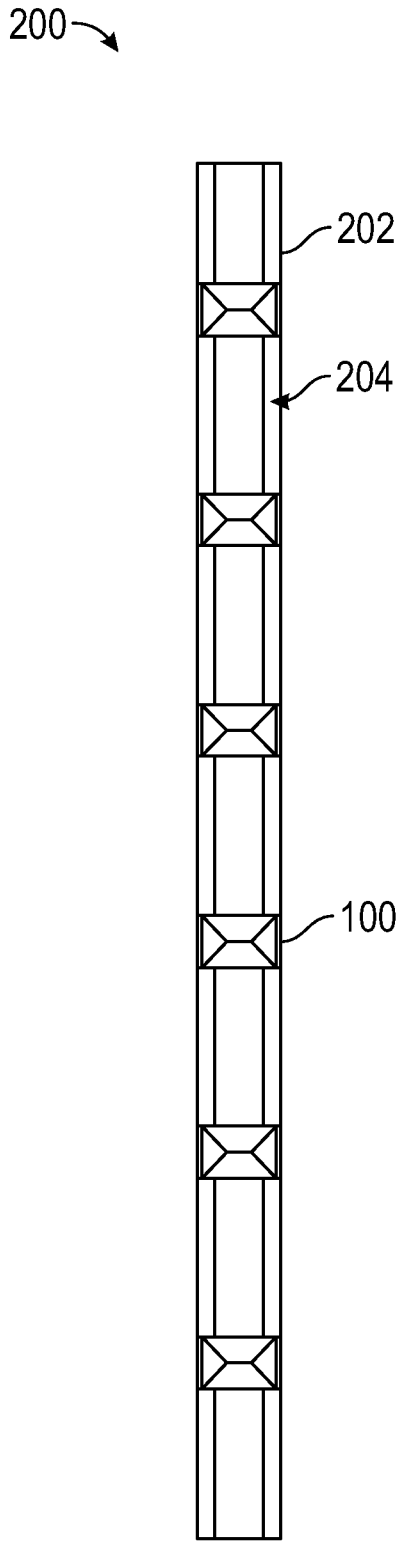
FIG. 2A is an elevation view of a downhole tool according to one embodiment.

The cutter 100, or a plurality thereof, is installed in a downhole tool for use. FIG. 2A is an elevation view of a downhole tool 200 according to one embodiment. The downhole tool 200 has a plurality of tubular support segments 202 that hold a plurality of the partial radial cutters 100, each cutter 100 supported between two segments 202. Each of the segments 202 can be a pipe, or each segment 202 can have cutout portions to reduce weight. Here, each segment has a plurality of vertically oriented cutout portions 204.

Seven cutters 100 are shown in the downhole tool 200, but any number can be used, depending on how many different cuts are required to idle the well. The seven cutters 100 of the downhole tool 200 are all oriented in the same direction, so the tool 200 can be used to make seven cuts through a well completion tubing and any accessory conduits at one location on the circumference of the well completion tubing.

Figure 2B:
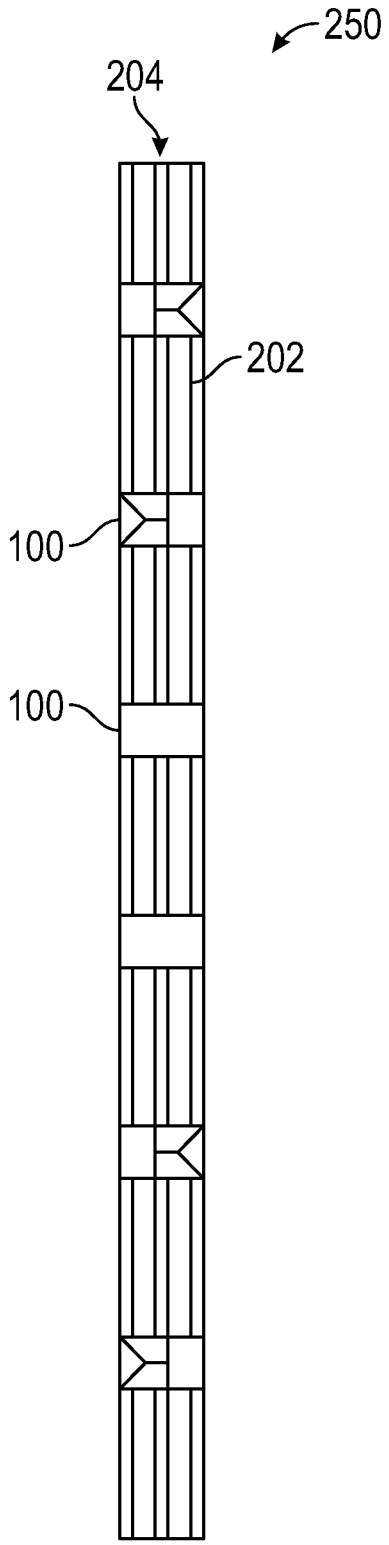
FIG. 2B is an elevation view of a downhole tool according to another embodiment.

Cutters, such as the cutter 100, assembled into a downhole tool can be oriented in different directions to accomplish cuts at different azimuthal locations. FIG. 2B is an elevation view of a downhole tool 250 according to another embodiment. In the downhole tool 250, neighboring cutters 100 are relatively rotated to point in different angular directions. In this case, each cutter 100 is rotated by an angle of about 90 degrees relative to its nearest neighbors. The downhole tool 250 can be used to make cuts at seven different depths with four different angular orientations. Such a tool can be used to cut through a well completion tubing and accessory conduits distributed around the entire circumference of the well completion tubing. Any angular distribution of cuts can be selected by rotating the cutters 100, of which any number can be assembled into a downhole tool.

Figure 3A:
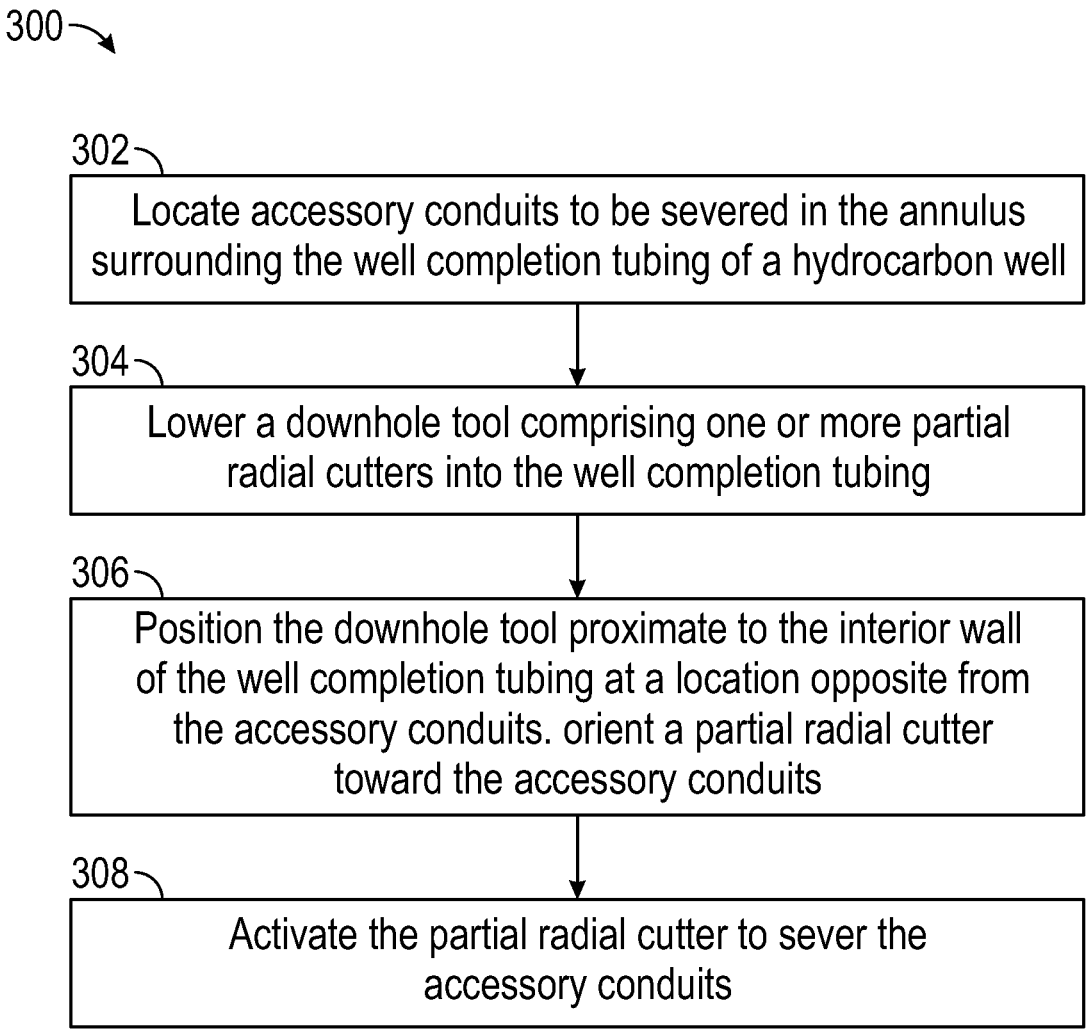
FIG. 3A is a flow diagram summarizing a method according to one embodiment.
Figure 3B:
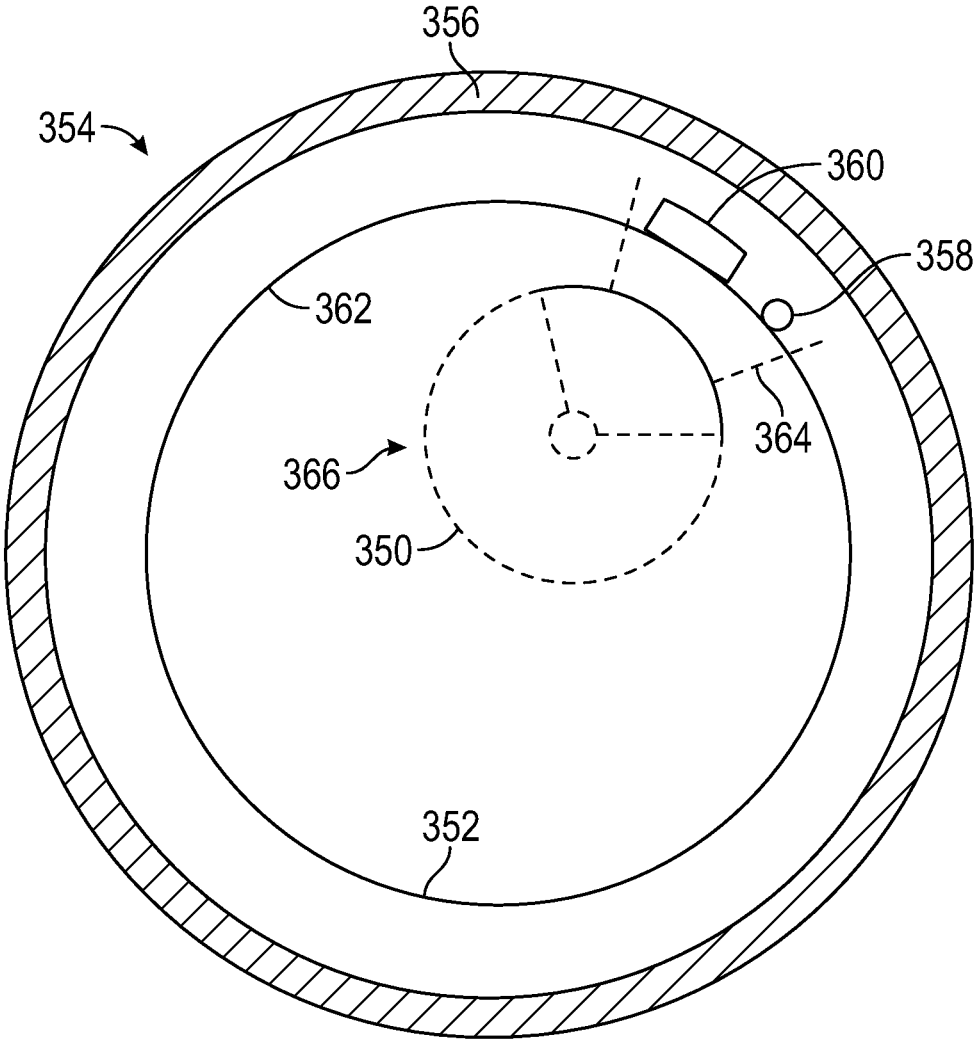
FIG. 3B is a usage illustration depicting portions of the method of FIG. 3A.

FIG. 3A is a flow diagram summarizing a method 300 according to one embodiment. FIG. 3B is a usage illustration depicting performance of portions of the method 300. FIG. 3B will be discussed together with FIG. 3A. At 302 accessory conduits in the annulus surrounding the well completion tubing of a hydrocarbon well to be idled are located. This can be done by consulting drawings or by detecting the location of the accessory conduits using known methods.

At 304, a downhole tool comprising one or more partial radial cutters is lowered into the well completion tubing of a hydrocarbon well. The one or more partial radial cutters are explosive tools that produce a discharge that propagates radially outward with minimal axial spread, in the cylindrical sense, and defined angular extent that is a portion of a circle.

At 306, the downhole tool is positioned proximate to the interior wall of the well completion tubing at a location opposite from the accessory conduits. The downhole tool is positioned a distance from the interior wall of the well completion tubing defined by the discharge characteristics of the explosive tools of the downhole tool. The distance is selected to facilitate the explosive discharge penetrating the well completion tubing and severing the accessory conduits without severing the well completion tubing entirely and without damaging the well casing. The partial radial cutter to be used to sever the accessory conduits is oriented to point toward the location of the accessory conduits to be severed. The discharge portion of the partial radial cutter to be used to sever the accessory conduits is oriented facing the accessory conduits such that a direction of the explosive discharge of the partial radial cutter is directed toward the accessory conduits.

FIG. 3B illustrates the operation 306. A downhole tool 350 is shown disposed within a well completion tubing 352 of a hydrocarbon well 354. The well 354 has a casing 356, and a plurality of accessory conduits that includes an accessory conduit 358 and a "flatpack" 360 of conduits located in the annular space between the well casing 356 and the well completion tubing 352. The downhole tool 350 includes a partial radial cutter 366 oriented toward the accessory conduits 358 and 360. Note that the well completion tubing 352 is shown here positioned concentric with the casing 356, but the well completion tubing 352 could be located off-center in some cases.

The downhole tool 350 is located proximate to an interior wall 362 of the well completion tubing 352 at a location opposite from the location of the accessory conduits 358 and 360 to facilitate directing the explosive discharge of the partial radial cutter 366 toward the interior wall 362 and toward the accessory conduits 358 and 360. The discharge, depicted by region 364 propagates radially outward toward the interior wall 362, and the downhole tool 350 is positioned a distance from the interior wall 362 selected to allow the discharge 364 to penetrate the interior wall 362 and sever the accessory conduits 358 and 360 without severing the well completion tubing 352 or substantially damaging the well casing 356.

The downhole tool 350 of FIG. 3B is shown with a partial radial cutter 366 that subsumes an angle of about 100 degrees. It is anticipated that the angular extent of the discharge from such a cutter would be at least 100 degrees and may be as much as 130 degrees. The region 364 has angular spread less than the entire discharge of the cutter 366, and is depicted as a region of the discharge that would be expected to sever the accessory conduits 358 and 360.

Returning to FIG. 3A, at 308, one or more of the explosive tools of the downhole tool is activated to sever the accessory conduits. The downhole tool can then be removed from the well or repositioned, if desired, to sever other accessory conduits located elsewhere in the cement sheath.

In accordance with certain embodiments of the present disclosure, a downhole tool includes a tubular support, and an explosive charge disposed within the tubular support. The explosive charge includes a casing having the form of a cylinder with a wedge portion removed to form a wedge opening, and a shaped charge shaped to fit the wedge opening. In some embodiments, an angular extent of the explosive charge is between about 90 degrees and about 130 degrees, inclusive. In some embodiments, the explosive charge and the casing have respective cutouts that form a conduit along a central axis of the downhole tool.

In some embodiments, the downhole tool includes an additional tubular support and an additional explosive charge disposed within the additional tubular support. In some embodiments, an orientation of the additional explosive charge in the additional tubular support is in a different direction than an orientation of the explosive charge in the tubular support. In some embodiments, the orientation of the additional charge in the additional tubular support is rotated about 90 degrees relative to the orientation of the explosive charge in the tubular support. In some embodiments, the casing has one or more alignment features that are configured to position the downhole tool in a desired direction. In some embodiments, the casing includes metal, plastic, or both. In some embodiments, the explosive charge includes a metal container that includes explosive material or a plastic container that includes the explosive material.

In accordance with certain embodiments of the present disclosure, a method of idling a hydrocarbon well includes positioning a partial radial cutter near an interior wall of a well completion tubing of the well at a location opposite from an accessory conduit disposed in the well outside the well completion tubing, with the discharge portion of the partial radial cutter facing the interior wall of the well completion tubing. The method also includes discharging the partial radial cutter to penetrate a portion of the interior wall and cut the accessory conduit. In some embodiments, the partial radial cutter includes an explosive charge. In some embodiments, the explosive charge includes a casing having the form of a cylinder with a wedge portion removed to form a wedge opening, and a shaped charge shaped to fit the wedge opening. In some embodiments, an angular extent of the explosive charge is between about 90 degrees and about 130 degrees, inclusive. In some embodiments, the method includes removing the partial radial cutter from the well. In some embodiments, the method includes repositioning the partial radial cutter near the interior wall of the well completion tubing of the well at a second location opposite from a second accessory conduit.

In accordance with certain embodiments of the present disclosure, a downhole tool includes a tubular support, and an explosive charge disposed within the tubular support. The explosive charge includes a casing having the form of a cylinder with a wedge portion removed to form a wedge opening, and a shaped charge shaped to fit the wedge opening. The angular extent of the explosive charge is between about 90 degrees and about 130 degrees, inclusive. In some embodiments, the angular extent is about 100 degrees.

In some embodiments, the downhole tool includes a partial radial cutter that includes the explosive charge. In some embodiments, the downhole tool includes an additional tubular support and an additional explosive charge disposed within the additional tubular support. In some embodiments, an orientation of the additional explosive charge in the additional tubular support is in a different direction than an orientation of the explosive charge in the tubular support.

The preceding description has been presented with reference to present embodiments. Persons skilled in the art and technology to which this disclosure pertains will appreciate that alterations and changes in the described structures and methods of operation can be practiced without meaningfully departing from the principle, and scope of this present disclosure. Accordingly, the foregoing description should not be read as pertaining only to the precise structures described and shown in the accompanying drawings, but rather should be read as consistent with and as support for the following claims, which are to have their fullest and fairest scope.

We claim:

1. A downhole tool, comprising:
a tubular support; and
a partial radial cutter comprising:
a circular top surface;
a circular bottom surface;
a casing having the form of a cylinder with a wedge portion removed to form a wedge opening such that the casing includes a top surface in the shape of a circle with the wedge portion removed and a bottom surface in the shape of a circle with the wedge portion removed, wherein the top surface of the casing partially defines the circular top surface of the partial radial cutter and the bottom surface of the casing partially defines the circular bottom surface of the partial radial cutter, and wherein the wedge portion has an angular extent between about 90 degrees and about 130 degrees inclusive; and
an explosive charge shaped to fit the wedge opening such that the explosive charge includes a top surface in the shape of the wedge portion and a bottom surface in the shape of the wedge portion, the top surface of the explosive charge partially defining the circular top surface of the partial radial cutter, and the bottom surface of the explosive charge partially defining the circular bottom surface of the partial radial cutter.

2. The downhole tool of claim 1, wherein the explosive charge of the partial radial cutter and the casing of the partial radial cutter have respective cutouts that form a conduit along a central axis of the downhole tool.

3. The downhole tool of claim 1, comprising an additional tubular support and an additional partial radial cutter, wherein the partial radial cutter is supported between the tubular support and the additional tubular support, and wherein the additional partial radial cutter is partially supported by the additional tubular support.

4. The downhole tool of claim 3, wherein an orientation of the explosive charge of the additional partial radial cutter is in a different direction than an orientation of the explosive charge of the partial radial cutter.

5. The downhole tool of claim 4, wherein the explosive charge of the additional partial radial cutter is rotated about 90 degrees relative to the explosive charge of the partial radial cutter.

6. The downhole tool of claim 3, wherein the additional tubular support includes a vertically oriented cut out portion extending between the partial radial cutter and the additional partial radial cutter.

7. The downhole tool of claim 1, wherein the casing has one or more alignment features that are configured to position the downhole tool in a desired direction, wherein the one or more alignment features are disposed on the top surface of the casing and are further disposed on either side of the wedge portion.

8. The downhole tool of claim 1, wherein the casing of the partial radial cutter comprises metal, plastic, or both.

9. The downhole tool of claim 1, wherein the explosive charge comprises a metal container that includes explosive material or a plastic container that includes the explosive material.

10. A method of idling a hydrocarbon well, comprising:
positioning a partial radial cutter near an interior wall of a well completion tubing of the well at a location opposite from an accessory conduit disposed in the well outside the well completion tubing, the partial radial cutter comprising:
a circular top surface;
a circular bottom surface;
a casing having the form of a cylinder with a wedge portion removed to form a wedge opening such that the casing includes a top surface in the shape of a circle with the wedge portion removed and a bottom surface in the shape of a circle with the wedge portion removed, wherein the top surface of the casing partially defines the circular top surface of the partial radial cutter and the bottom surface of the casing partially defines the circular bottom surface of the partial radial cutter, and wherein the wedge portion has an angular extent between about 90 degrees and about 130 degrees inclusive; and
an explosive charge shaped to fit the wedge opening such that the explosive charge includes a top surface in the shape of the wedge portion and a bottom surface in the shape of the wedge portion, the top surface of the explosive charge partially defining the circular top surface of the partial radial cutter, the bottom surface of the explosive charge partially defining the circular bottom surface of the partial radial cutter, and the explosive charge facing the interior wall of the well completion tubing; and
discharging the partial radial cutter to penetrate a portion of the interior wall and cut the accessory conduit.

11. The method of claim 10, comprising removing the partial radial cutter from the well.

12. The method of claim 10, comprising repositioning the partial radial cutter near the interior wall of the well completion tubing of the well at a second location opposite from a second accessory conduit.

13. The method of claim 10, wherein positioning the partial radial cutter near the interior wall of the well completion tubing at the location opposite from the accessory conduit disposed in the well outside the well completion tubing includes positioning the partial radial cutter such that a longitudinal axis of the partial radial cutter is offset from a longitudinal axis of the well completion tubing.

14. A downhole tool, comprising:

a tubular support including a first tubular support and a second tubular support; and a partial radial cutter disposed between and supported by the first tubular support and the second tubular support, the partial radial cutter comprising:

a circular top surface;

a circular bottom surface;

a casing having the form of a cylinder with a wedge portion removed to form a wedge opening such that the casing includes a top surface in the shape of a circle with the wedge portion removed and a bottom surface in the shape of a circle with the wedge portion removed, wherein the top surface of the casing partially defines the circular top surface of the partial radial cutter and the bottom surface of the casing partially defines the circular bottom surface of the partial radial cutter, and wherein the wedge portion has an angular extent between about 90 degrees and about 130 degrees inclusive; and an explosive charge shaped to fit the wedge opening such that the explosive charge includes a top surface in the shape of the wedge portion and a bottom surface in the shape of the wedge portion, the top surface of the explosive charge partially defining the circular top surface of the partial radial cutter, and the bottom surface of the explosive charge partially defining the circular bottom surface of the partial radial cutter.

15. The downhole tool of claim 14, wherein the angular extent is about 100 degrees.

16. The downhole tool of claim 14, comprising an additional partial radial cutter partially supported by the second tubular support.

17. The downhole tool of claim 16, wherein an orientation of the explosive charge of the additional partial radial cutter is in a different direction than an orientation of the explosive charge of the partial radial cutter.

18. The downhole tool of claim 16, wherein the second tubular support includes a vertically oriented cut out portion extending between the partial radial cutter and the additional partial radial cutter.

* * * * *